United States Patent [19]

Sharpe et al.

[11] Patent Number: 5,022,160

[45] Date of Patent: Jun. 11, 1991

[54] HAND-OPERATED POWER TOOL

[76] Inventors: Steven E. Sharpe, Dannatt House, 81 Brigg Road, Barton-on-Humber, South Humberside, DN18 5DX; Garry Brewin, 27 Beckhill, Barton-on-Humber, South Humberside, DN18 5HQ; Richard Sharpe, Widband, Elm Lane, North End, Goxhill, Barrow-on-Humber, South Humberside, DN19 7JU, all of England

[21] Appl. No.: 476,400

[22] PCT Filed: Dec. 5, 1988

[86] PCT No.: PCT/GB88/01052

§ 371 Date: Jun. 5, 1990

§ 102(e) Date: Jun. 5, 1990

[87] PCT Pub. No.: WO89/05220

PCT Pub. Date: Jun. 15, 1989

[30] Foreign Application Priority Data

Dec. 5, 1987 [GB] United Kingdom ..... 8728517

[51] Int. Cl.[5] ..... B27C 1/10; B27C 5/10

[52] U.S. Cl. ..... 30/475; 144/225

[58] Field of Search ..... 30/475–477, 30/169, 323; 144/117 R, 117 C, 131, 230, 218, 225; 407/89, 90, 113, 115

[56] References Cited

U.S. PATENT DOCUMENTS

| | | | |
|---|---|---|---|
| 1,357,985 | 11/1920 | Impalea | 30/475 |
| 1,614,783 | 1/1927 | Fekete . | |
| 1,636,863 | 7/1927 | Jehle . | |
| 2,649,874 | 8/1953 | Konopa . | |
| 2,771,104 | 11/1956 | Saxe . | |
| 2,997,081 | 8/1961 | Christophersen . | |

FOREIGN PATENT DOCUMENTS

| | | |
|---|---|---|
| 187226 | 7/1907 | Fed. Rep. of Germany . |
| 159465 | 3/1933 | Fed. Rep. of Germany . |
| 2445233 | 4/1976 | Fed. Rep. of Germany . |
| 733246 | 10/1982 | France . |
| 13592 | 9/1916 | United Kingdom . |
| 295348 | 8/1928 | United Kingdom . |

*Primary Examiner*—Douglas D. Watts

*Attorney, Agent, or Firm*—Burns, Doane, Swecker & Mathis

[57] ABSTRACT

A power tool includes a housing, a cylindrical cutter block rotatably mounted and a drive to rotate the cutter block. Front and rear sole plates support the tool on a work piece.

14 Claims, 4 Drawing Sheets

HAND-OPERATED POWER TOOL

HAND-OPERATED POWER TOOL

The present invention relates to a power tool for shaping, shaving, chamfering, trimming and otherwise working workpieces of wood and other similar materials. More specifically, the power tool is suitable for planing concave and convex curves of varying raii, as well as flats in a workpiece.

Spokeshave planes are known for shaping wooden wowrkpieces and generally comprise a cutting blade mounted on a flat or rounded sole plate. Two handles, each extending from a respective side of the sole plate allow the plane to be held against the workpiece. The design of the spokeshave plane is such that it can be used to shape the surface or a workpiece with much greater effectiveness than other types of plane. However, as with all planes considerable physical effort must be exerted on the part of the user to work it over the surface of the workpiece. Moreover, it will only plane in one direction namely the direction in which the cutter blade is pointing which means that the user must turn it round each time he wants to plane in the opposite direction to the one he is working in. Finally, because the spokeshave plane must be pushed or pulled over the surface of the workpiece to operate effectively it is extremely difficult to use it in a relatively confined area to work concave curves of relatively small internal radii in the surface of the workpiece.

It is an object of the present invention to provide a power tool for shaping, shaving, chamfering, trimming and otherwise working workpieces which obviates or, at least, substantially mitigates the disadvantages of spokeshave planes referred to hereinabove.

According to the present invention there is provided a power tool comprising a cylindrical cutter block, drive means to rotatably drive the cutter block about its central axis, at least one cutting blade mounted in the cutter block parallel with the central axis thereof, and front and rear sole plates on which the power tool is supported, in use, against a workpiece, the front and rear sole plates being spaced from each other to define an elongate slot therebetween, parallel with the central axis of the cutter block, through which the cutting blades each extend as the cutter block rotates, wherein the front and rear sole plates are curved about the central axis of the cutter block.

The cutter block is rotatably driven at very high speed and as it does so waste is shaved from the area of the workpiece immediately facing the elongate slot by the cutter blades. The relatively short overall length of the front and rear sole plates, together with the fact that they are curved about the central axis of the cutter block made the power tool ideally suited for forming relatively intricate shapes in the surface of a workpiece. This ability is certainly enhanced by the fact that the power tool is about to shave waste from the workpiece as it is moved both towards and away from the user.

Indeed, where the power tool is required to operate in a relatively confined area it will shave waste from the workpiece if it is simply rotated back and forth about its central axis to move the elongate slot over the surface thereof. This technique can also be used to work concave curves of relatively small internal radii in the surface of a workpiece. As no, or almost no, pushing or pulling of the power tool is necessary to make it shave waste from the workpiece, it can be used to work concave curves of substantially the same internal radii as the radii of the curved sole plates. In fact, as the power tool is rotated back and forth it works its way into the workpiece until a point is reached where the maximum width of the recess formed is only slightly greater than the width of the power tool, whence the power tool can continue to increase the depth of the recess without substantially increasing the width of the recess. This is certainly not possible with a conventional spokeshave plane where pushing and pulling of the plane to shave waste from a workpiece inevitably results in concave curves worked in a workpiece being very much larger than the actual base length of the plane.

A further advantage of the power tool is that it will only cut waste from a workpiece as it is moved across the surface of the workpiece. In other words it will not dig in to or gouge the workpiece if it is left on one spot. Once the cutter blades have removed waste from the workpiece by the distance they extend from the elongate slot the front and rear sole plates support the power tool on the workpiece and prevent the cutting blades getting close enough to the workpiece to remove any more waste. Apart from the fact that this gives complete control of the depth of cut and provides obvious safety advantages, it also means that the support bearings for the cutter block are not subject to heavy loads.

Preferably, the cutter block is enclosed within an essentially tubular housing having an elongate slot therein which extends parallel with the central axis thereof. The housing prevents shavings cut from the workpiece being thrown towards the user and also prevents the user from touching the rotating cutter block whilst the power tool is in use. Conveniently, the front and rear sole plates are each defined by a respective edge of the said elongate slot. Alternatively, the front and rear sole plates may each be secured to a respective edge of the said enlongate slot. Where separate front and rear sole plates are provided these are conveniently comprised of, for example, mild steel and flanges are povided to facilitate attachment to the tubular housing. Preferably, an opening is provided in the said housing through which shavings cut from the workpiece are expelled.

Preferably, a handle is provided at each end of the tubular housing. These allow the user to hold the power tool in both handles and ensure that the power tool is easy and safe to handle in use. Preferably, at least one of the handles is detachably secured to the said tubular housing to allow the cutter block to be introduced into the tubular housing through the open end thereof. The other handle may also be detachably secured to the housing, but is preferably an integral extension thereof. It will be appreciated that this construction readily facilitates dismantling of the power tool to allow inspection, cleaning of the housing and cutter block, and replacement of the cutting blades. This is particularly advantageous for a power tool intended for the do-it-yourself market.

Preferably, the drive means comprises an electric motor and power is supplied to the electric motor via a pair of normally off switches, each of which is mounted in a respective one of the two handles. Together, these ensure that the user must have both hands on the power tool to operate it, thereby preventing the power tool from being incorrectly handled and minimising the risk of accident or injury to the user.

Preferably, the cutter block is mounted on a drive shaft, one end of which is connected to the drive means and the other end of which is supported in a bearing ring. The drive shaft may be connected directly to the drive means. Alternatively, it may be connected to the drive shaft via a slipping clutch or a drive belt.

In one embodiment of the present invention the drive means comprises an electric drill and the drive shaft is clamped in the chuck thereof. Preferably, means are provided for securing the said tubular housing to the casing of the electric drill. Conveniently, this takes the form of a support ring which is connected to the tubular housing and fits over the forward end of the electric drill casing. The support ring ensures that the electric drill and the housing, together, form an integral unit and prevents undue leverage being exerted directly on the chuck and drive shaft of the electric drill.

In a second embodiment of the present invention the drive means comprises a dedicated electric motor. The dedicated electric motor may be mounted in one of the handles, or it may be mounted in a compartment within the tubular housing above the cutter block. The separate compartment is necessary to ensure that the electric motor and the connecting means therefrom to the drive shaft of the cutter block do not become clogged up with shavings from the workpiece. Preferably, in this particular case the said connecting means comprises a drive belt.

Conveniently, the cutter block comprises three cutter blades, each equi-angularly spaced about its circumference. Preferably, the blades are each mounted in a respective slot in the cutter block and are releasably secured therein by means of fixing screws or Allan screws.

Preferably, shaping or guide members are provided for attachment to the housing. These guide means may comprise flat, angled or curved plates, or elongate bars which are adapted to be secured to the housing at each end of the elongate slot, or in front and behind the elongate slot. The plates and bars may be secured to the housing by means of fixing screws, or they may be received in slots specially provided for the purpose in the housing. Amongst other things these plates and bars enable a workpiece to be chamfered, rabbeted or simply planed flat, and they also set the radii of internal and external curves to be cut in a workpiece.

Where the guide means are used to adjust the opening of the elongate slot, that is to say where they are secured at one or both ends of the elongate slot, they provide a useful safety feature. In this respect, it will be understood that where the width of the workpiece being worked on is less than the normal length of the elongate slot the guide members cover the ends of the cutting blades which are not actually in contact with the worksurface. These would otherwise be exposed and could be accidentally touched.

Preferably, the guide members comprise a pair of plate members, which extend, respectively, forward of and rearward of the elongate slot and are pivotable about an axis extending parallel with the elongate slot. These guide members effectively extend the base length of the power tool and ensure that a smoothly planed surface is obtained where the power tool is used over relatively large areas. In this respect, it must be understood that the relatively short base length of the front and rear sole plates results in ripples in the surface being tracked and amplified when the power tool is moved over the surface thereof. However, where th power tool is provided with plate members in front of and behind the elongate slot these effectively bridge any irregularities in the surface of the workpiece making for a much smoother planed surface. Being pivotable the plate members will automatically adjust their position to accommodate both flat surfaces and curved surfaces.

Preferably, each guide member is pivotably secured to a support member which is in turn secured to the power tool housing. Conveniently, the support member comprises a U-shaped bar, the plate member being pivotably secured to the middle thereof, and each end of the U-shaped bar is slidably received in a slotted member carried by the power tool housing. Being adjustable relative to the power tool housing the support members allow the plate members to be set above, below or in line with the elongate slot, thereby allowing them to adjust their position to accommodate internal curves (concave), external curves (convex) and flats. Preferably, each plate member comprises an essentially flat plate with the forward and rearward edges thereof curved about its pivotal axis. Alternatively, each plate member may define a flat surface on one face thereof and a curved surface on the opposite face and is pivotably through 180 degrees to allow either surface to be brought into contact with the workpiece.

Embodiments of the present invention will now be described, by way of example, with reference to the accompanying drawings, in which.

Figure 1:
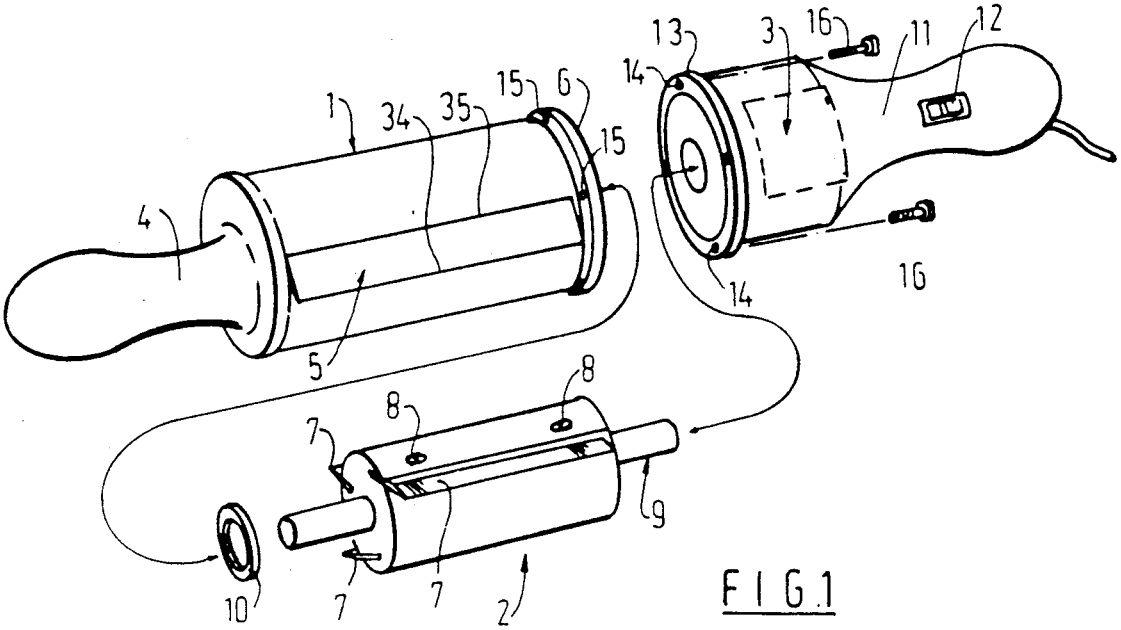
FIG. 1 shows an exploded view of a power tool according to a first embodiment of the present invention in which the electric drive motor is mounted in one of the handles thereof.

Referring firstly to FIG. 1 there is shown an exploded view of a power tool according to the present invention comprising an essentially tubular housing 1, a cylindrical cutter block 2, and an electric motor 3. A flange 6 is provided aroung the open end of the housing 1 and an integral handle 4 is provided at the other end. The housing 1 is open along one side to define an elongate slot, indicated by reference 5, extending the length of the housing 1, parallel with its central axis, and the sides of the housing 1, immediately adjacent the slot 5, define front and rear sole plates 34 and 35, respectively.

Three slots are provided around the periphery of the cutter block 2 and in each of these there is releasably mounted a cutting blade 7 which is secured in position by Allan screws 8. The cutting edge of each blade 7 extends beyond the top of the slot in which it is mounted. The cutter block 2 is mounted on a drive shaft 9, one end of which is keyed to the rotor (not shown) of the electric motor 3 and the other end of which is adapted to be received in a bearing ring 10 mounted inside the housing 1 in the inner end of the handle 4.

The electric motor 3 is mounted within a motor housing 11 which is shaped in the form of a handle. The electric motor 3 is connected to a source of electrical power (not shown) via an on/off finger switch 12 mounted in the side of the housing 11. A flange 13 is provided around the perimeter of the housing 11 which matches the flange 6 around the open end of the tubular housing 1. When the two housings 1 and 11 are brought together the cutter block 2 is introduced into the tubular housing 1 and the non-driven end of the drive shaft 9 is received in the bearing ring 10. Holes 14 in the flange 13 are then aligned with corresponding screw threaded holes 15 in the flange 6 and bolts 16 are inserted through the holes 14 and into the holes 15 to secure the two housings 1 and 11 together. When the power tool is assemebled the axis of rotation of the cutter block 2 is slightly offset from the central axis of the housing 1 towards the elongate slot 5. As a result, the cutting edge of each cutting blade 7 extends slightly beyond the edges 34 and 35 of the elongate slot 5 when it is positioned therein.

In use the power tool is held in both hands and the switch 12 is operated to supply power to the drive motor 3. The drive motor 3 drives the cutter block 2 about its central axis and as the cutter block rotates the cutting blades 7 sweep through the slot 5 in the housing 1. The power tool is then placed on the surface of a workpiece with the elongate slot 5 over the area thereof to be worked and shavings are cut from this area as the rotating cutter blades 7 sweep through the elongate slot. The depth to which each cutting blade 7 cuts into the workpiece is determined by the distance it projects beyond the edges 34 and 35 of the elongate slot 5. Thus the edges 34 and 35 support the power tool on the workpiece and prevent the cutting blades 7 gouging the workpiece. It is envisaged that a power tool comprising three cutting blades 7 and comprising a conventional power tool electric motor would be capable of between 20,000 to 30,000 cuts/minute.

By moving the power tool back and forth over the surface of the workpiece internal and external curves can be formed in the workpiece, and edges can be rounded and chamfered. Thus, relatively intricate and complex shapes can be formed in the workpiece with the minimum of effort on the part of the user. Indeed, by simply rotating the power tool back and forth about its central axis concave curves can be shaped in the surface of a workpiece of substantially the same radii as the radii of the front and rear sole plates 34 and 35. In this respect, complete control of the power tool is exercised at all time and because no effort is required on the part of the user to effect a cutting action there need be no enlargement of the concave curve caused by pushing the power tool as there usually is with a spokeshave plane.

In order to facilitate cleaning or inspection of the power tool, or replacement of the cutting blades the unit is simply dismantled by unscrewing the bolts 16 and withdrawing the cutter block 2 from the housing 1.

Figure 2:
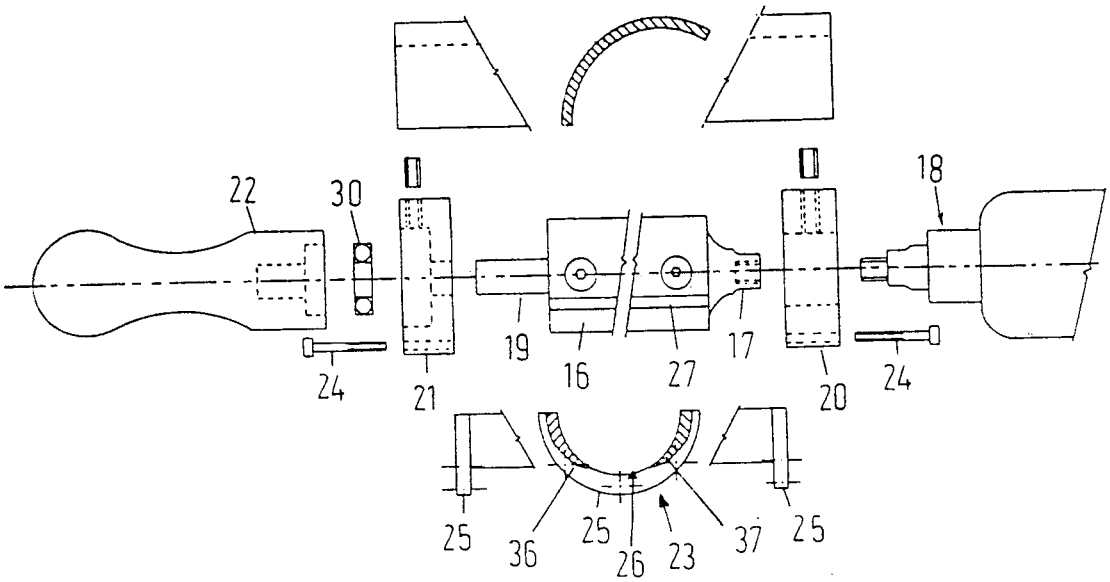
FIG. 2 shows an exploded view of a power tool according to a second embodiment of the present invention in which the cutter block is rotatably driven by an electric drill, only partially shown.

Referring now to FIG. 2 of the accompanying drawings there is shown a second embodiment of a power tool according to the present invention. The power tool shown is used with an electric drill and is not provided with its own discrete electric drive.

The power tool comprises a cylindrical cutter block 16 which is generally similar to the cutter block 2 of FIG. 1. The cutter block 16 comprises an integral drive shaft 17 which is tapered and adapted, in use, to be gripped in the chuck of an electric power drill 18, and a support shaft 19. The drive shaft 17 is received in a support collar or ring 20 which is of sufficient internal diameter to receive the forward end of the casing of the electric power drill 18. The support shaft 19, is received in a bearing ring 30 mounted in a second support ring or collar 21, which is itself mounted in a recess handle 22.

A guide member 23 is provided between the two support collars 20 and 21, and is secured in place by means of bolts 24 which screw through holes in the collars 20 and 21 into screw threaded holes in flanges 25 provided at each end of the guide member 23. The guide member 23 is of essentially semi-circular cross-section and defines an elongate slot, indicated by reference 26, which extends substantially its full length. The sides of the guide member define front and rear sole plates 36 and 37. The axis of rotation of the cutter block 16 is offset slightly from the central longitudinal axis of the guide 23 towards the elongate slot 26. This ensures that the cutting blades 27 carried by the cutter block 16 extend through and beyond the elongate slot 26 as they pass it on the rotating cutting block 16. This arrangement is best seen in the cross-sectional view of the power tool shown in FIG. 3.

Also secured between the support collars 20 and 21 is a guard piece 28 which deflects shavings from the workpiece away from the operator. This guard is comprised of transparent perspex material to facilitate observation of the cutter block and the workpiece whilst the power tool is in use.

Figure 3:
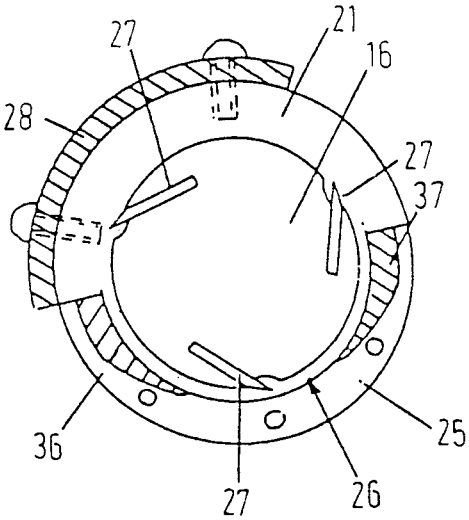
FIG. 3 shows a cross-section through the power tool of FIG. 2 when assembled along lines II—II.

Operation of the embodiment of the power tool according to the present invention shown in FIGS. 2 and 3 is substantially the same as for that of FIG. 1.

Figure 5:
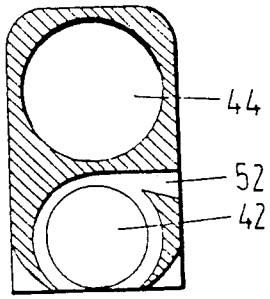
FIG. 5 shows a cross-section through the power tool of FIG. 4 along lines IV—IV.
Figure 4:
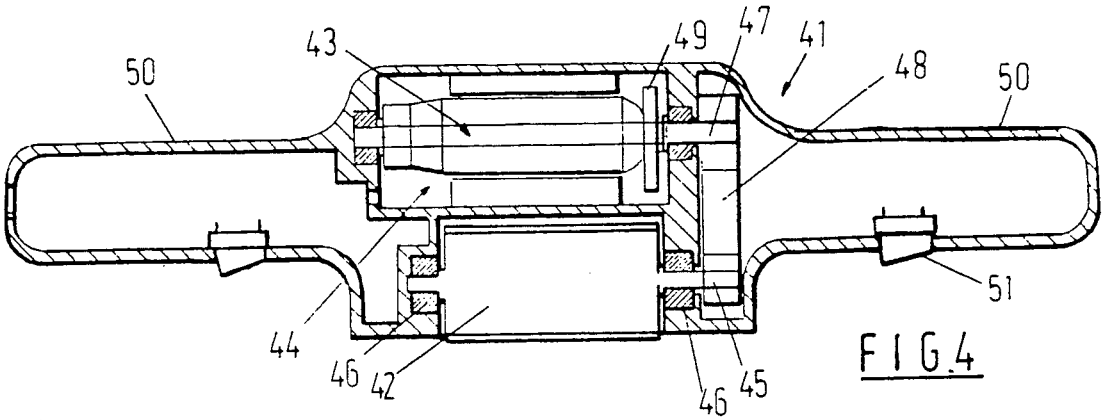
FIG. 4 shows a schematic view of a power tool according to a third embodiment of the present invention in which the housing has been cut away at the front to show an electric drive motor mounted in a separate compartment of the housing above the cutter block.

Referring now to FIGS. 4 and 5 of the accompanying drawings there is shown yet another power tool according to the present invention. As with the previous embodiments the power tool comprises a housing 41, a cylindrical cutter block 42 and an electric motor 43. However, in this embodiment the electric motor 43 is mounted above the cutter block 42 in a compartment indicated by reference 44. The drive shaft 45 of the cutter block 42 is supported at each end in bearing rings 46 and is connected to the drive shaft 47 of the electric motor 43 by a drive belt 48. A small fan 49 is mounted on the drive shaft 47 to ensure that the motor is kept cool whilst in use. A handle 50 extends from each side of the housing 41 and in each handle 50 is mounted a normally open circuit switch 51. Though the electrical wiring of the power tool is not shown in the drawings it should be understood that these switches 51 are connected in series, thereby ensuring that the power tool is only operable when the user has both hands on the power tool to operate both switches.

As can be seen in FIG. 5 an opening, indicated by reference 52, is provided in the side of the housing 41. This opening leads from the housing compartment in which the cutter block is mounted and allows shavings cut from a workpiece to be expelled, thereby ensuring that the power tool does not become clogged up with shavings whilst in use.

Referring now to FIGS. 6 to 10 of the accompanying drawings there are shown a number of different guide members for use with the power tool according to the present invention.

Figure 6:
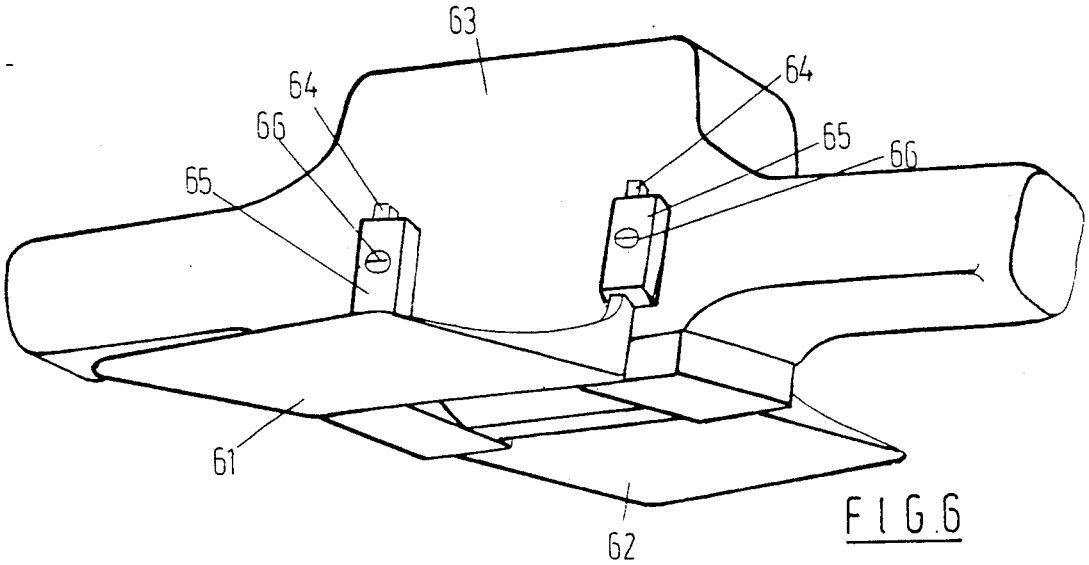
FIGS. 6 to 10 each show a perspective view of the power tool of FIG. 4 fitted with different guide members; and, FIG. 11 shows a power tool comprising yet another form of guide member.

In FIG. 6 the guide means comprise two flat plates 61 and 62 which are secured to the front and rear, respectively, of the power tool housing 63. The plates 61 and 62 provide an elongate base which allows the power tool to operate after the fashion of a conventional electric plane. As will be readily appreciated alternative securing means may be used, but in this particular instance each plate 61 and 62 comprise a pair of elongate rods or lugs 64 which are each received in a slotted member 65 on the side of the housing 63. The lugs 64 are adjustable within the slotted members 65 to allow the distance of the power tool cutting blades (not visible) from the surface of a workpiece to be varied. Once the plates 61 and 62 are appropriately adjusted they can be secured in position by tightening a screw 66 carried by each slotted member 65.

Figure 7:
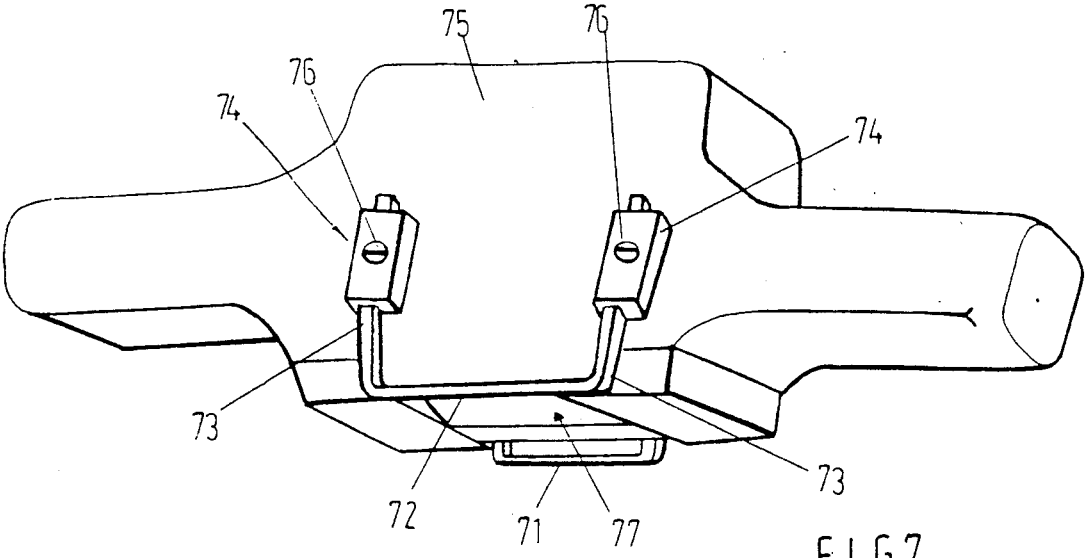

Now referring to FIG. 7 there is shown alternative guide means comprising a pair of substantially U-shaped bars 71 and 72. In similar fashion to the arrangement of FIG. 6 the upright legs 73 of the bars 71 and 72 are each received in slotted members 74 on the front and rear faces of the power tool housing 75 and are secured in the desired position by means of locking screws 76 carried by the slotted members. The distance by which the bars 71 and 72 extend beyond or behind the elongate slot 77 determines the internal and external diameters of curved sections to be cut from a workpiece.

Figure 8:
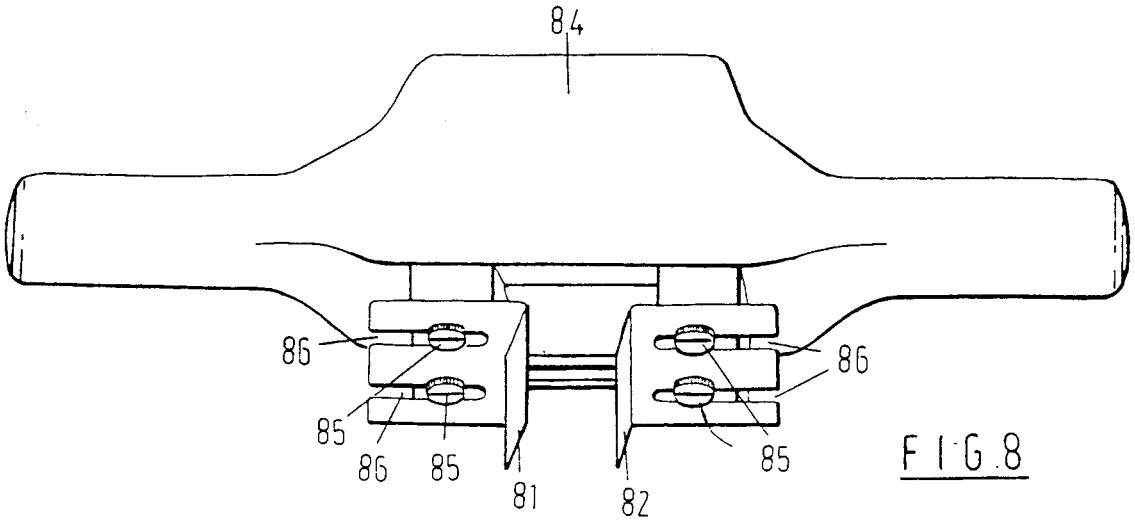

In FIG. 8 the guide means comprise a pair of right angled brackets 81 and 82 which are each secured to a respective side of the elongate slot 83 in which the power tool cutting blades (not visible) lie. The brackets 81 and 82 are each secured to the power tool housing 84 by means of a pair of locking screws 85, each of which is screwed into the housing 84 through an elongate slot 86 in the bracket 81, 82. The distance between the two brackets 81 and 82 can be adjusted by slackening the locking screws 85 and sliding the brackets 81 and 82. In use the brackets 81 and 82 maintain the power tool perpendicular to the sides of a workpiece to be worked on by securing the sides of the workpiece therebetween, thus ensuring a straight perpendicular edge of the workpiece.

Figure 9:
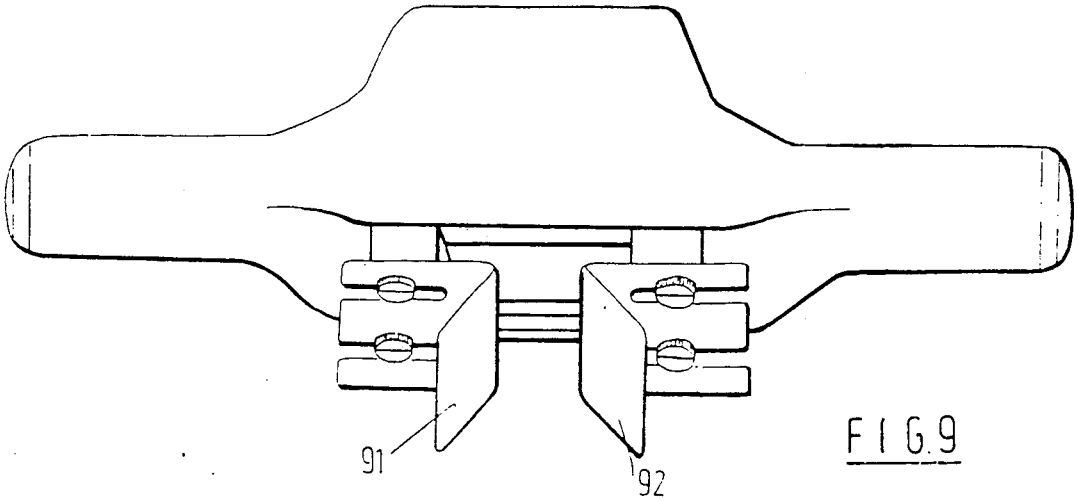

In FIG. 9 the guide means are essentially the same as that of FIG. 8, except that the two brackets 91 and 92 are angled. These allow the edge of a workpiece to be accurately chamfered.

Figure 10:
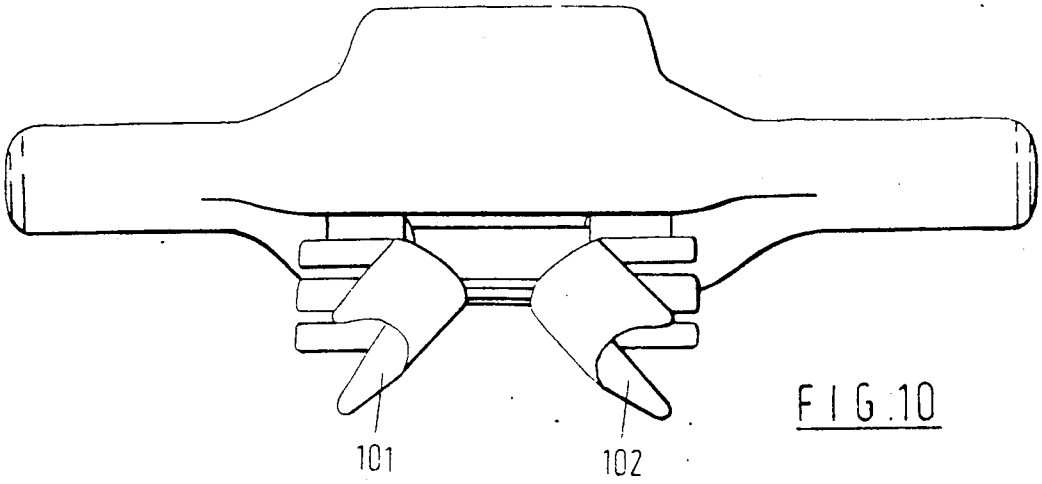

Finally, FIG. 10 shows a power tool fitted with a pair of curved brackets 101 and 102. These allow a workpiece having a curved edge to be accurately chamfered.

With the guide means of FIGS. 8, 9 and 10 it will be understood that the length of the elongate slot through which the cutter block is actually exposed can be adjusted to exactly equal the width of the workpiece being worked on. This is an important safety feature as it ensures that there is no exposed cutter block on either side of the workpiece which might accidentally be touched.

Figure 11:
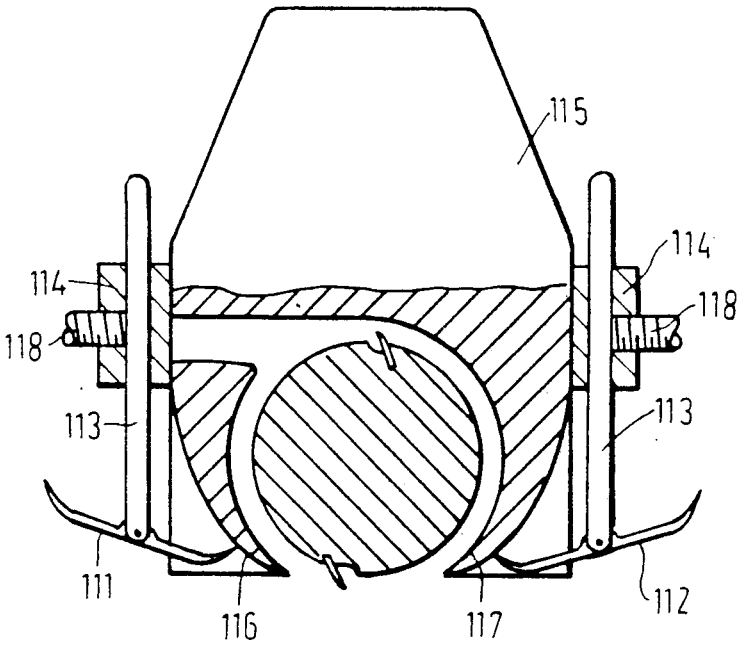

Referring now to FIG. 11 of the accompanying drawings there is shown yet another form of guide means for use with the power tool according to the present invention. In this respect, the guide means comprises a pair of plates 111 and 112 each of which is pivotably mounted on a support member 113. Each support member 113 takes the form of a substantially U-shaped bar and the plate 111, 112 is pivotable about the central portion thereof. The free ends of each U-shaped bar 113 are received in slotted members 114 carried by the power tool housing 115 such that each plate member 111 and 112 is pivotable about an axis extending parallel with the central axis of the power tool. The free ends of each U-shaped bar 113 are slidable within the slotted members 114 and this allows the position of the plate member associated therewith to be adjusted relative to the front and rear sole plates 116 and 117 and the elongate slot defined therebetween. A locking screw 118 is provided in each slotted member 114 and this is tightened to secure the end of the U-shaped bar 113 therein. The forward and rearward edges of each plate member 111 and 112 are curved about the pivotal axis thereof, but otherwise the plate members are flat.

The plate members 111 and 112 effectively extend the base length of the power tool and ensure that a smoothly planed surface is obtained where the power tool is used over relatively large areas. The plate members 111 and 112 effectively bridge any irregularities in the surface of the workpiece making for a much smoother planed surface and being pivotable they automatically adjust their position to accommodate both flat surfaces and curved surfaces. The plate members 111 and 112 also facilitate the shaping of multi-directional planes.

In an alternative embodiment of the guide means of FIG. 11 the plate members shown may be replaced with plate members which comprise a flat surface on one face and a curved surface on the opposite face. As will be readily appreciated the flat surfaces are used for planing flats on a work surface, whilst the curved surfaces are used for planing internal radii.

What is claimed is:

1. A power tool comprising a cylindrical cutter block, drive means to rotatably drive the cutter block about its central axis, at least one cutting blade mounted in the cutter block parallel to the central axis thereof, and front and rear sole plates on which the power tool is supported, in use, against a workpiece, the front and rear sole plates being spaced from each other to define an elongate slot therebetween parallel to the central axis of the cutter block through which the cutting blades each extend as the cutter block is rotated, and being curved about the central axis of the cutter block wherein a guide member is releasably secured to the housing at one end of the elongate slot and is adjustable to partially cover the elongate slot and thereby to vary the effective length of the cutter blades which are exposed therethrough.

2. A power tool according to claim 1, wherein a guide member is releasably and adjustably secured to the housing at each end of the elongate slot.

3. A power tool according to claim 1, wherein the or each guide member comprises a first portion whereby it is secured to the housing and a second portion which, in use, is braced against a side of the workpiece being worked.

4. A power tool according to claim 3, wherein slots are provided in the said first portion of the guide member through which means for securing the guide member to the housing extend, which slots facilitate adjustment of the guide member relative to the end of the elongate slot.

5. A power tool according to claim 3, wherein the said second portion of the guide member is perpendicular to the longitudinal axis of the elongate slot.

6. A power tool according to claim 3, wherein the said second portion of the guide member is angled relative to the longitudinal axis of the elongate slot.

7. A power tool according to claim 5, wherein the said second portion of the guide member is curved about an axis extending perpendicular, or substantially perpendicular, to the longitudinal axis of the elongate slot.

8. A power tool according to claim 1, wherein a further guide member is releasably secured to the front and to the rear of the housing.

9. A power tool according to claim 1, wherein the cutter block is enclosed within an essentially tubular housing having an elongate slot therein which extends parallel with the central axis thereof.

10. A power tool according to claim 9, wherein the front and rear sole plates are each defined by a respective edge of the said elongate slot.

11. A power tool according to claim 8, wherein the front and rear sole plates are each secured to a respective edge of the said elongate slot.

12. A power tool according to claim 1, wherein a handle is provided at each end of the housing.

13. A power tool according to claim 12, wherein at least one of the handles is detachably secured to the said tubular housing to allow the cutter block to be introduced into the tubular housing through the open end thereof.

14. A power tool according to claim 1, wherein the drive means is mounted in a compartment within the housing.

* * * * *